United States Patent [19]

Peterson, Jr.

[11] 4,128,822

[45] Dec. 5, 1978

[54] POLYPHASE CIRCUIT BREAKER HAVING IMPROVED TRIP CROSSBAR ASSEMBLY

[75] Inventor: Maurice W. Peterson, Jr., Swisher, Iowa

[73] Assignee: Square D Company, Park Ridge, Ill.

[21] Appl. No.: 773,092

[22] Filed: Feb. 28, 1977

[51] Int. Cl.[2] ..... H01H 71/16

[52] U.S. Cl. ..... 335/8; 335/9; 337/48; 337/50

[58] Field of Search ..... 335/8–10, 335/20–23; 337/45–50; 200/50 A, 50 C, 337

[56] References Cited

U.S. PATENT DOCUMENTS

| | | | |
|---|---|---|---|
| 2,824,191 | 2/1958 | Christensen | 337/50 |
| 3,233,063 | 2/1966 | Platz | 335/9 |
| 3,341,791 | 9/1967 | Leonard | 337/73 X |
| 3,345,591 | 10/1967 | Leonard et al. | 337/48 X |
| 3,355,685 | 11/1967 | Leonard | 200/144 R X |
| 3,414,850 | 12/1968 | Couper | 335/8 |
| 3,422,381 | 1/1969 | Toth | 335/9 |
| 3,758,887 | 9/1973 | Ellsworth et al. | 335/8 |
| 4,066,989 | 1/1978 | Krueger | 337/50 X |

*Primary Examiner*—James R. Scott

*Attorney, Agent, or Firm*—Norton Lesser; Richard T. Guttman

[57] ABSTRACT

The following specification describes a circuit breaker trip crossbar having diverging radial surfaces receiving a tapered rail therebetween. The rail extends from the bottom edge of the conventional breaker barrier wall recess and forms a small area pivot adjacent the crossbar axis to reduce the torque required to pivot the bar and to render the torque reproducible for calibration purposes.

The radial surfaces are economically formed by flat mold surfaces in opposite mold halves to avoid mold flash in the pivot area while enabling one of the mold halves to conventionally form the latch plate securing hole in the crossbar.

11 Claims, 12 Drawing Figures

POLYPHASE CIRCUIT BREAKER HAVING IMPROVED TRIP CROSSBAR ASSEMBLY

BACKGROUND OF THE INVENTION

1. Field of the Invention

This invention relates in general to circuit breaker trip crossbars and more particularly to an improved pivot means or method for forming a pivot for a circuit breaker trip crossbar.

2. Summary of the Prior Art

Trip crossbars utilized in circuit breakers usually carry a metal latch plate for latching the contact resetting or operating assembly of the circuit breaker. The assembly can then be operated for moving and holding the contacts in closed position and when the bar is rotated in response to a fault condition, the latch plate is disengaged from the operating assembly which opens or restores the circuit breaker contacts.

The crossbar is an elongated molded plastic member having axially spaced arcuate bottom surfaces each pivotally engaged with the edge of a respective wedge shaped recess formed in a respective compartment or barrier wall of the breaker. The arcuate surfaces are actually formed on an eccentric portion of the bar, which requires a relative deep wide wall recess to accommodate rotation of the eccentric portion. This renders encircling restraint of the crossbar difficult to provide.

The arcuate surfaces being displaced from the crossbar axis of rotation and having relatively large area of engagement require a relatively large torque to overcome the friction between the bar and recess edges, while the minimal encircling restraint contributes to the friction and wear problems of the bar. It also renders calibration difficult since each rotational movement of the bar may vary from the others.

The wear, friction and calibration problems are further complicated by the necessity to apply the forces for pivoting or tripping the bar in response to a fault condition at asymmetrical locations with respect to the inadequately restrained crossbar resulting in eccentric movement of the bar relative to the support surfaces of the recess further complicating the force, wear and calibration problems.

The metal latch plate is secured to the crossbar by a rivet passing through a hole in the arm extending transverse to the elongate bar axis. For economical molding of the hole in the bar, one mold half may carry a pin and form the hole and the opposite halves of the mold engage along parting lines spaced angularly substantially 90° from the hole axis and extending along the arcuate or pivot surfaces of the bar. Parting lines may in some instances also be formed along the barrier wall recess edges that engage the pivot surfaces of the bar. The parting lines create some flash along the pivot surfaces which is inordinately expensive to remove. The flash introduces contaminants between the pivot surfaces and creates a variable load resisting crossarm pivoting. This further contributes to the problem of calibrating the tripping forces required to release the reset or operating assembly.

SUMMARY OF THE INVENTION

The present invention eliminates the flash problem at the crossbar pivot surfaces and reduces the torque required for pivoting movement by providing two diverging radial surfaces on the bar nestingly receiving a tapered rail on the bottom surface of each compartment wall recess to form a small area fixed pivot adjacent the crossarm axis. This reduces the required pivoting torque and renders the applied torque reproducible to facilitate accurate calibration.

The radial surfaces on the bar extend from each other at a greater angle than the taper on the rail to control the arc through which the crossarm can pivot. The radial surfaces are formed by axially displaced flat surfaces on opposite mold halves so that the mold parting lines are displaced from the pivot area. This avoids the problem of having flash and contaminants interfering with the pivot movement while retaining the economic advantage of forming the latch plate rivet hole with a single pin carried by one of the mold halves. The tapered rail is created by a single recess in the mold portion forming the barrier wall recess edges to also avoid the formation of a parting line in the pivot area.

It is therefore an object of the present invention to provide an improved trip crossbar for a circuit breaker.

It is another object of the present invention to provide improved and more economical pivot means for a circuit breaker trip crossbar.

It is still another object of the present invention to provide an improved or more economical method for forming pivot means for a circuit breaker.

Other objects and the features of the present invention will become apparent on examination of the following specification and claims together with the accompanying drawings.

DESCRIPTION OF THE PREFERRED EMBODIMENT

Figure 1:
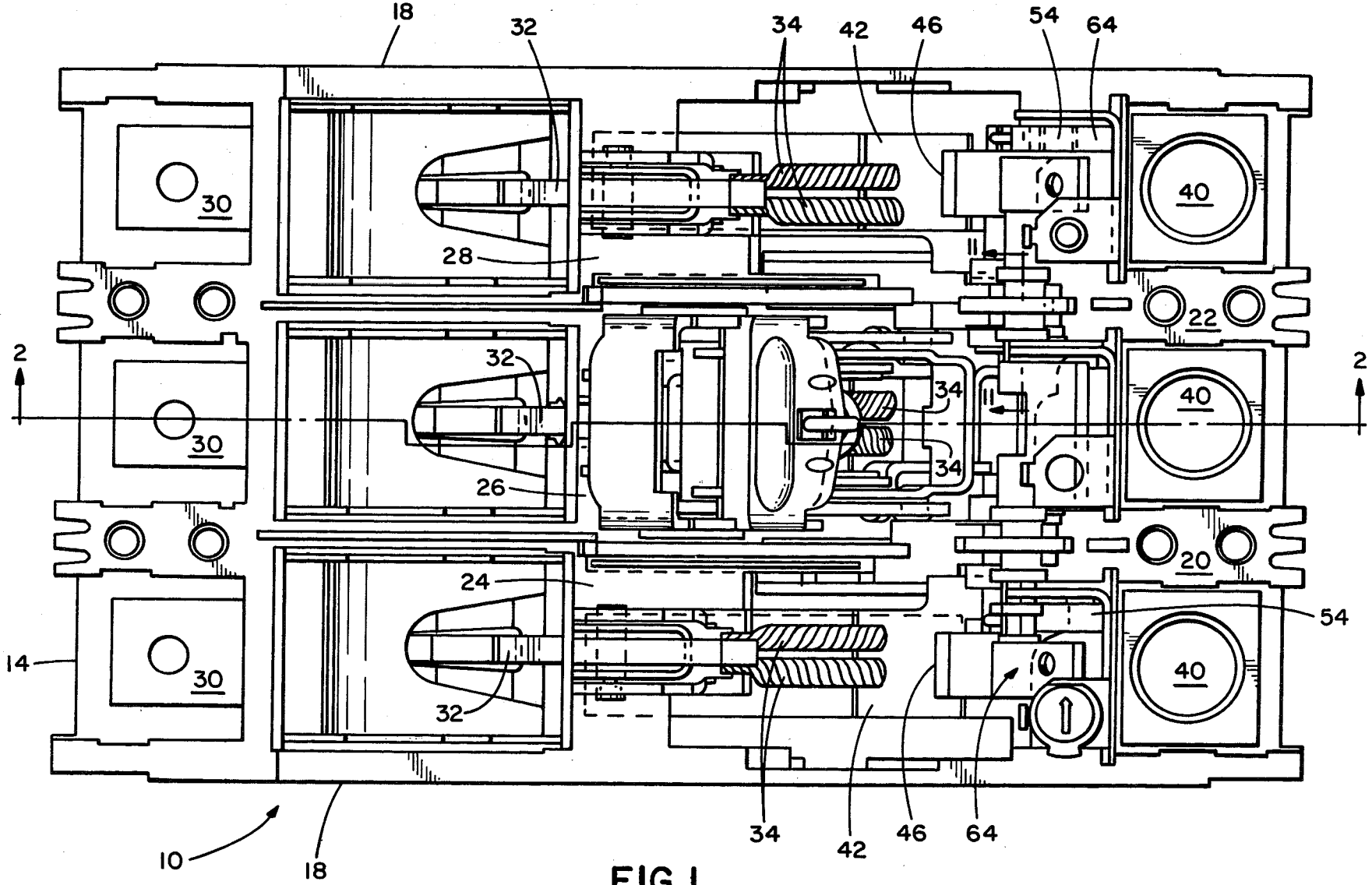
FIG. 1 is a top elevational view of a portion of a circuit breaker incorporating the principles of the present invention.
Figure 2:
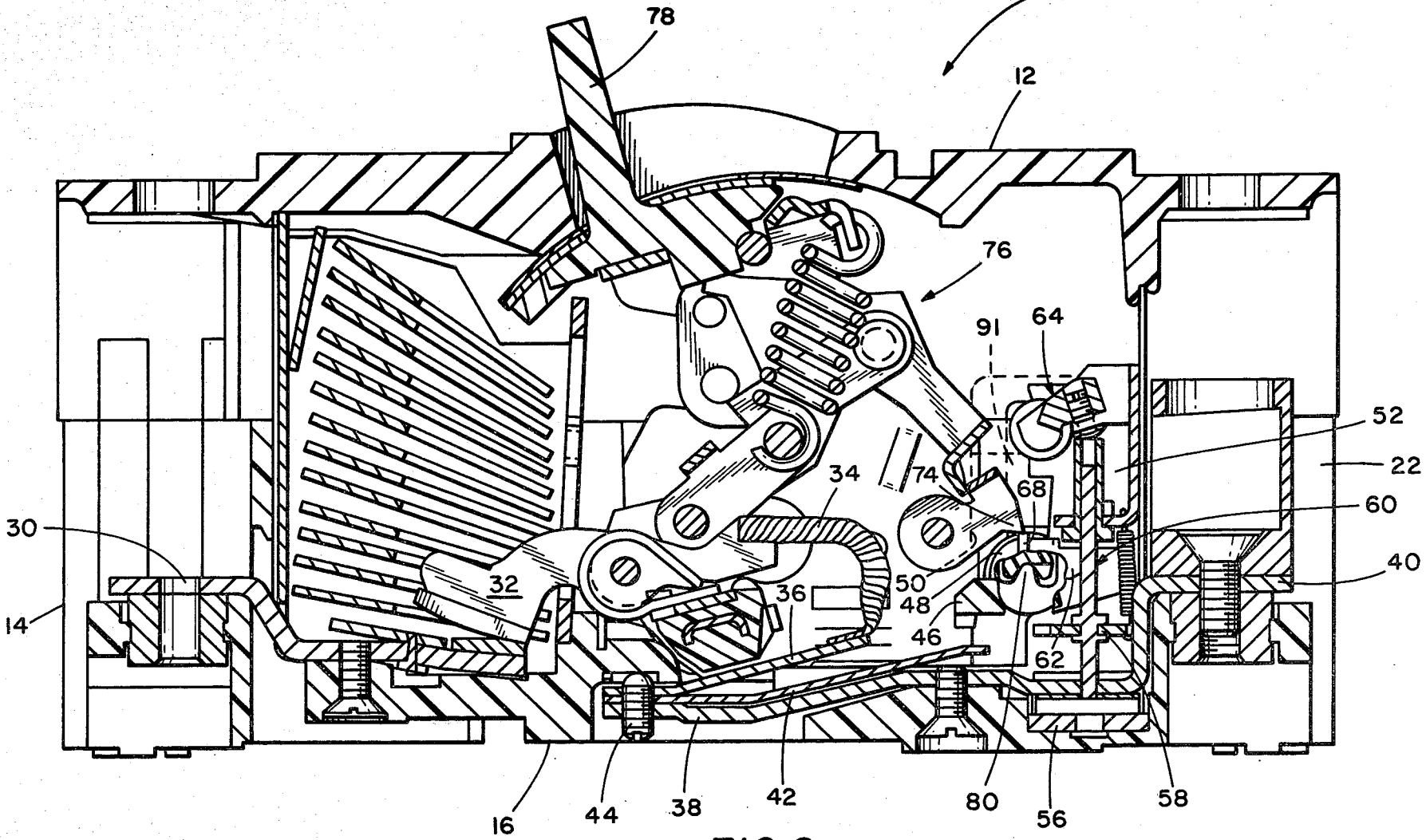
FIG. 2 is a sectional view taken generally along the lines 2—2 in FIG. 1.

In FIGS. 1 and 2 the relevant portion of a multi-pole circuit breaker for use in a three phase circuit is indicated generally by the reference character 10.

The circuit breaker 10 has a top cover indicated at 12 in FIG. 2 and includes a moulded base 14 having a back or bottom wall 16, longitudinally extending side walls 18 and a pair of spaced barrier or compartment walls 20 and 22 located intermediate the side walls 18 to define three compartments 24, 26 and 28 as seen in FIG. 1. Each compartment 24, 26 and 28 has a line terminal portion 30 adjacent one compartment end. Portion 30 is provided for conventionally connecting a respective line conductor (not shown) through contacts associated with a respective movable or pivotable contact arm 32, and through a flexible or braided conductor 34 secured to a conductor 36. Conductor 36 extends to a flat conductor 38 located adjacent the bottom wall 16 of the base 14 for connecting terminal 30 to a load conductor (not shown) at terminal portion 40 adjacent the opposite end of the respective compartment. Each compartment also includes conventional arc extinguishing and other apparatus together with transverse walls, which are indicated but not identified as they have no major relevance to the invention.

One end of a cantilever bimetal strip 42 is connected intermediate the conductors 36 and 38. Strip 42 extends from between conductors 36 and 38 generally parallel to and adjacent the respective flat conductor 38 to an upwardly bent free end, whose position is adjusted by calibrating screw 44 for operating a respective tripping lug 46 best seen in FIGS. 1–7. Lug 46 extends from a trip crossbar 48 and is operated or pivoted by the bimetal strip 42 in response to a predetermined thermal condition of conductor 38 indicating a prolonged overcurrent situation. Operation of lug 46 by strip 42 pivots the bar 48 clockwise as seen in FIG. 2.

Figure 9:
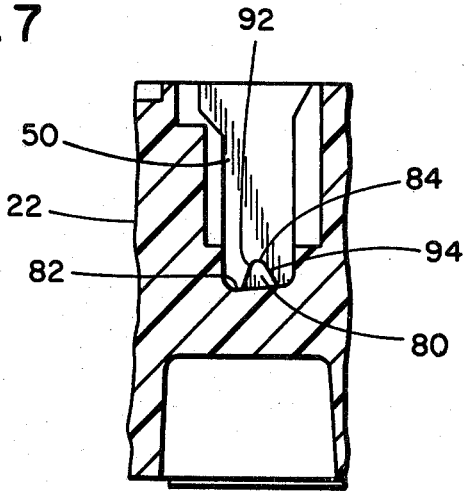
FIG. 9 is a fragmentary side elevational view of the wall recess seen in FIG. 8.
Figure 10:
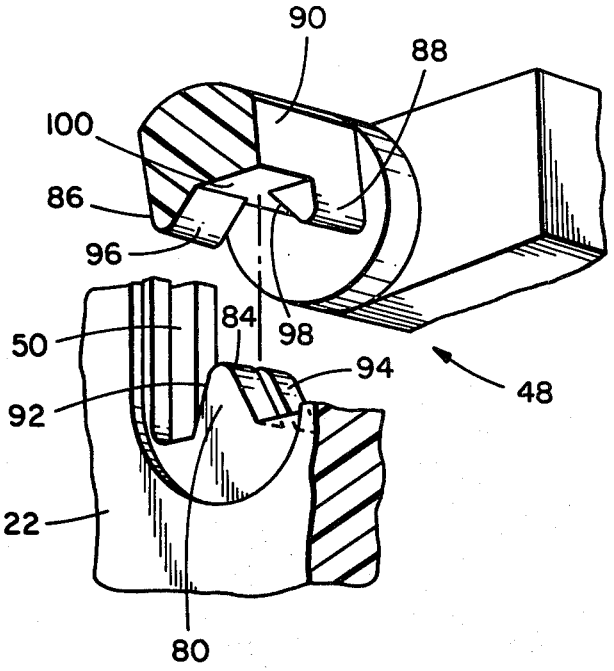
FIG. 10 is a fragmentary exploded isometric view of the trip cross arm and compartment wall recesses for supporting the cross arm.
Figure 11:
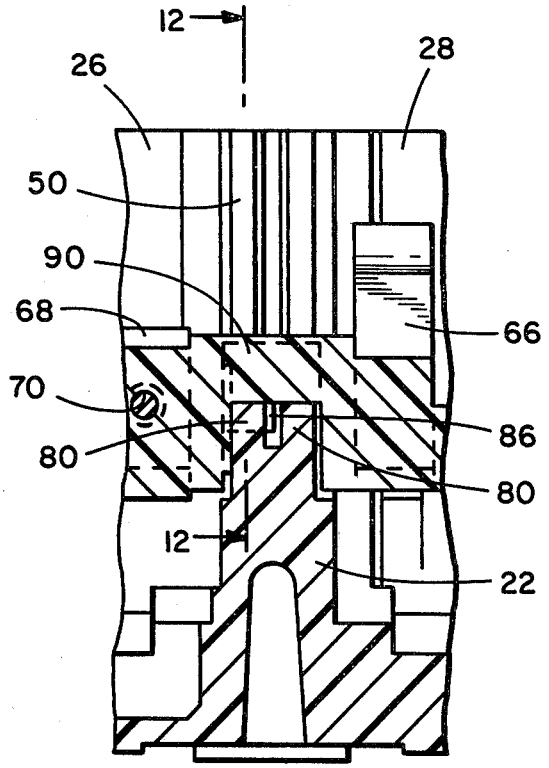
FIG. 11 is a fragmentary sectional view taken generally along the line 11—11 in FIG. 1.
Figure 12:
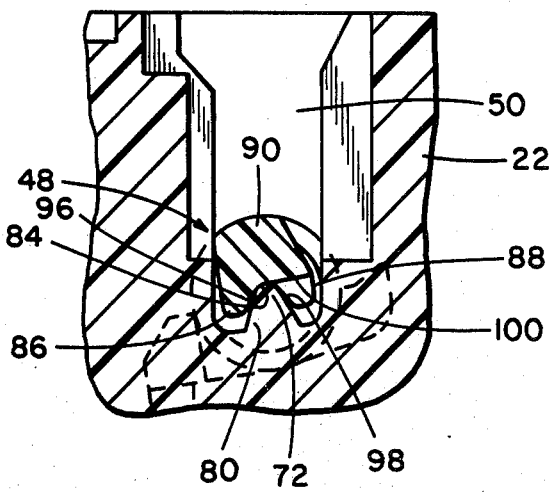
FIG. 12 is a sectional view taken generally along the line 12—12 in FIG. 11.

The crossbar 48 extends through a respective recess 50 best seen in FIGS. 9, 10 and 12 in each wall 20 and 22 into each compartment 24, 26 and 28 where the crossarm is adapted to be pivoted either by a respective one of three spaced bimetal strips 42 or in response to the operation of a respective one of three conventional electromagnetic assemblies 52. A pair of spaced spring members 54 located in compartments 24 and 28 respectively bias the crossarm 48.

Each electromagnetic assembly 52 comprises a U shaped magnetically susceptible member 56 located beneath conductor 38 and in a recess of the bottom wall 16 of the base 14. Member 56 responds to a fault current of predetermined amplitude through the respective conductor 38 to operate or attract a respective spring biased armature or plunger 58. Armature 58 reciprocates a rod assembly 60 passing through a respective forked tripping lug 62 on the crossbar 48 to engage the lug 62 in response to a fault current greater than a predetermined value passing through the respective conductor 38. Lug 62 pivots the crossbar 48 clockwise as seen in FIG. 2. A conventional adjustment crossarm assembly 64 is provided to control the reaction of each armature assembly 60 and thereby select or calibrate the fault current value at which the crossbar is pivoted or operated.

Figure 3:
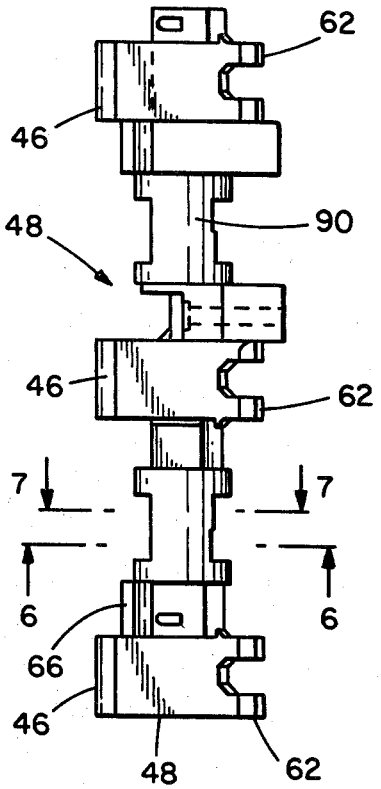
FIG. 3 is top elevational view of a trip cross arm incorporating the principles of the present invention and utilized in the circuit breaker shown in FIGS. 1 and 2.
Figure 4:
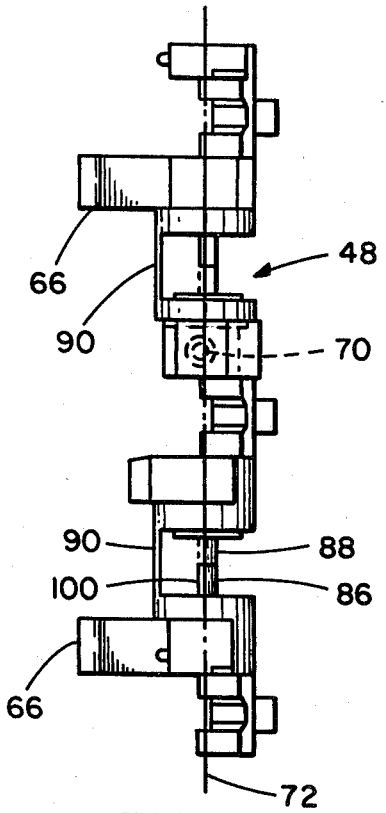
FIG. 4 is side elevational view of the cross arm shown in FIG. 3.
Figure 5:
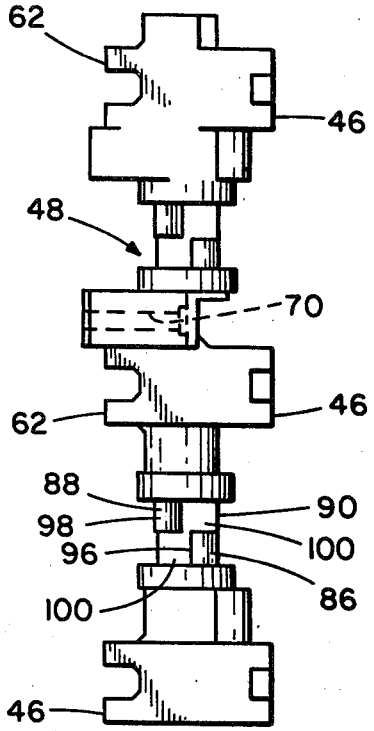
FIG. 5 is a bottom elevational view of the cross arm shown in FIG. 3.
Figure 6:
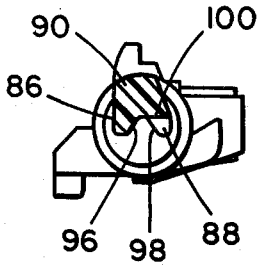
FIG. 6 is a sectional view taken generally along the lines 6—6 in FIG. 3.
Figure 7:
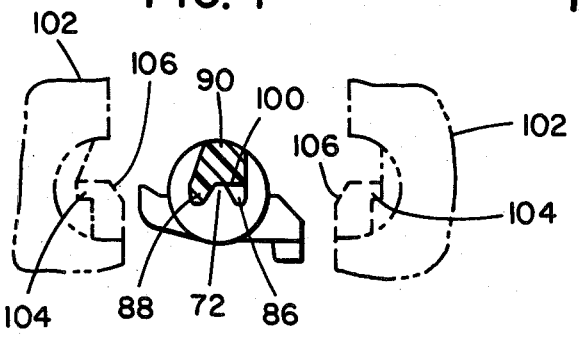
FIG. 7 is a sectional view taken generally along the lines 7—7 in FIG. 3.
Figure 8:
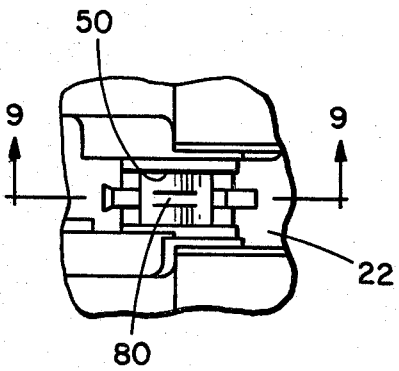
FIG. 8 is a fragmentary top elevational view of a compartment wall recess in which the cross arm is received.

The crossbar 48, if desired, is also provided with other tripping lugs such as 66 seen in FIG. 3 in addition to lugs 46 and 62. Lug 66 is operated by auxiliary device such as an undervoltage coil.

A vertically extending latch plate 68 is located in the center compartment 26 on the bar 48. Plate 68 is secured to a flat vertical face of the bar 48 by a rivet passing through a radially extending rivet hole or passage 70 and adjacent the longitudinal axis 72 of the bar 48 indicated in FIGS. 4, 7 and 12, for example.

The latch plate 68 is normally engaged by a spring biased trip crossbar retainer 74 of a conventional operating or reset assembly 76. When the trip cross bar 48 is pivoted by either an overload or fault current condition, the retainer 74 is released to in turn release the operating assembly 76. The released operating assembly 76 releases each movable contact arm 32 to interrupt the circuits between the line and load terminals 30 and 40.

The operating assembly 76 is thereafter conventionally operable by means of handle or arm 78 extending through the cover 12 of the breaker to reset the assembly 76 and close the contacts controlled by arm 32 for reestablishing the circuits when the fault condition is corrected.

The crossbar 48 is pivotally supported in each barrier wall recess 50 by means of a respective tapered rail 80 projecting from the bottom surface or edge 82 of each recess 50. Each rail 80 has a radiused end surface 84 located intermediate a pair of shoulders or axially displaced stops 86 and 88 extending radially from a respective eccentric portion 90 of the crossbar 48. The eccentric portions 90 extend between axially offset tripping lugs to rigidify the bar. Since the bar rotates about the axis indicated at 72 a relatively wide deep recess 50 is required to accommodate movement of the eccentric portions. Barrier inserts 91 are conventionally located in each recess 50 above the eccentric portions 90.

Each tapered rail 80 has a front surface 92 extending upwardly from the bottom recess edge 82 at an angle of substantially 15° to the vertical axis of the rail and a back or rear surface 94 extending upwardly at substantially 30° with both front and rear surfaces 92 and 94 spaced from the vertical edges of recess 50 to accommodate the stops 86 and 88. The two surfaces 92 and 94 thus subtend an angle of substantially 45° and converge toward each other and toward the radiused end surface 84. Surface 84 is formed on a radius of substantially 0.04 inch from a center of rotation located substantially coincident with the axis 74 on receipt of surfaces 92 and 94 between the crossarm radial shoulders 86 and 88.

As mentioned front crossarm shoulder 86 is axially displaced from rear shoulder 88. Each shoulder has a facing, but axially displaced, flat radial face or surface 96 and 98 respectively. Faces 96 and 98 are each initiated from a position located at one side and adjacent the central axis 72 of the bar and diverge past the central axis at an angle of substantially 35° to a vertical plane as best visualized from FIGS. 6 and 7. The flat radial faces 96 and 98 thus subtend an angle of substantially 70° or substantially 25° greater than the rail to enable the bar to pivot through a corresponding angle of substantially 25°. Each flat radial surface 96 and 98 merges at its inner radial end adjacent the bar axis along a radius of 0.04 inch with a respective flat generally horizontal radial face 100 for nestingly receiving the radiused end rail surface 84.

Faces 100 for each pair of stops 86 and 88 extend in opposite radial directions in coplanar parallel relationship and are axially displaced. This facilitates the formation of each stop face 96 and 98 on the respective stops 86 and 88 by a different mold half indicated at by dashed lines 102 in FIG. 7. Each front stop radial surface 96 is thus normally engaged with the front rail face 92 under the bias of springs 54. Each coplanar flat surface 100 extends radially in an opposite generally horizontal direction substantially parallel to the axis of the latch plate rivet hole 70.

As may be appreciated the crossbar 48 is formed conventionally on the injection and curing of a plastic moulding material between the two mold halves 102, which define a cavity. The eccentric portions 90, lugs 46 and 62 are formed with the rivet hole 70 preferably defined by a pin carried in one mold half and partially received by the other half. In forming the cavity, each mold half is provided with a recess or pocket 104 having a margin formed by a projecting portion 106 on the other half to define the surfaces 96 and 98 and the flat coplanar radial surfaces 100. Thus the projecting portion 106 in each mold half is axially displaced and these move past each other to form the respective flat radial surface 100 together with the transverse radial surfaces 96 and 98. The parting line for the pockets 104 and the projecting portions 106 are conveniently formed at the axially displaced edges of faces 96, 98 and 100 to avoid having a parting line at the pivot surfaces. The possibility of mold flash developing along the pivot surfaces is therefore avoided while the mold halves move conventionally relative to each other to form the rivet hole 70 along an axis substantially parallel to the flat surfaces 100 and the supporting flanges for the latch plate.

Likewise the tapered rail 80 is formed by a simple recess in a mold portion, which defines the edges of recesses 50 to avoid forming a longitudinal parting line extending along the recess edges.

When breaker 10 responds to a fault condition, either the bimetal member 42 engages lug 46, if a prolonged overload condition is present, or the armature assembly 60, engages the lug 62 if a fault condition of tripping magnitude is present. In either event the trip crossbar 48 is pivoted clockwise as seen in FIGS. 2 and 12, for example.

The crossbar 48 pivots against the bias of springs 54 about the pivot axis 72 located adjacent the center of rotation of the radiused surface 84 of rail 80. Since the torque arm extending from the lugs 46 or 62 is large relative the radial distance between the pivot axis 72 and the engaged surfaces of the rail 80 and bar 48, considerable leverage is provided to ensure that frictional or other forces are overcome. The front stop surface 96 pivot from the front rail surface 92 and only a small area of surface engagement is provided at surface 84 so that frictional resistance is minimized.

With the pivot surfaces held close to the axis 72 extending through each rail, eccentric type pivoting movement of axis 72 is substantially avoided, since the engaged surfaces 92 and 96 adjacent one end of the crossbar initially resist swiveling forces applied at the other end of the bar. When the cross arm 48 pivots through the selected arc, the rear stop 88 engages the rear face 94 of rail 80 to terminate a further bar tripping movement.

The latch plate 68 in the meantime releases the retainer 74 to in turn cause the operating assembly 76 to release the movable arm 32 for opening the circuits between terminals 30 and 40. The bar 48 restores under the influence of bias springs 54.

Thereafter when the fault condition is corrected, the handle 78 is conventionally moved to control the operating assembly 76 for reengaging the retainer 74 with the latch plate 68 and for controlling the arm 32 to complete the circuits between the terminals 30 and 40. The trip cross arm 48 is now positioned to enable another release operation.

The foregoing describes an improved circuit breaker trip cross arm pivot and method for forming the pivot; however the invention is not believed limited to the described embodiment, but instead is believed encompassed in the accompanying claims.

I claim:

1. A multi-pole circuit breaker including a moulded base having a bottom wall, longitudinally extending side walls and a pair of spaced apart parallel compartment walls located intermediate said side walls to define a plurality of compartments with each compartment wall having a recess, a pair of contacts in each compartment controlled by an operating assembly to extend an electrical circuit from a line terminal through a load terminal and including fault condition sensing means adapted to sense a fault condition in said circuit to control a trip crossbar having a longitudinal axis extending through said recess of each compartment wall and to pivot said crossbar for releasing said operating assembly to open said contacts in response to a fault condition in said circuit, the improvement comprising:

a pair of first surfaces on said crossbar formed at a predetermined diverging angle to each other and extending in a radial outward direction, and a rail integrally formed on each compartment wall and projecting transverse to said longitudinal axis into a respective one of said recesses and having second surfaces converging towards each other at an angle less than said predetermined angle for receipt between said pair of first surfaces to provide a pivot axis for said crossbar.

2. The multi-pole circuit breaker claimed in claim 1 in which said longitudinal axis of said crossbar is substantially coincident with said pivot axis.

3. The multi-pole circuit breaker claimed in claim 1 in which said second surfaces merge with an end surface having a predetermined radius at the projecting end of said rail, and said first surfaces each have a corresponding radius at an adjacent position to engage said end surface for rotational movement relative to said end surface.

4. The multi-pole circuit breaker claimed in claim 3 in which said crossbar has a central longitudinal axis located intermediate said pair of first surfaces.

5. The multi-pole circuit breaker claimed in claim 4 in which said first radially extending surfaces are displaced axially of said crossbar from each other to enable each first radial surface to be formed by a respective different mold half.

6. The multi-pole circuit breaker claimed in claim 1 in which said converging surfaces meet along a radiused juncture and each first surface has a similarly dimensioned radius for engagement with said radiused juncture.

7. In a multi-pole circuit breaker of the type including a moulded base having a bottom wall, longitudinally extending side walls and a pair of spaced compartment walls located intermediate said side walls to define a plurality of compartments with each compartment wall having a recess, a pair of contacts located in each of said compartments and controlled by an operating assembly, a trip crossbar extending through each recess and carrying a latch plate for engagement by a crossbar retainer in said operating assembly to enable said operating assembly to retain said contacts closed to extend an electrical circuit, and fault sensing means for sensing a fault condition in said circuit to control said crossbar to disengage said latch plate from said retainer plate to enable said operating assembly to open said circuit, the improvement comprising:

a tapered rail integrally formed on each compartment wall projecting transversely to the longitudinally axis of said crossbar into a respective one of the said recesses, a passage in said crossbar extending radially from the longitudinal axis of said crossbar adapted to receive a fastener for securing said latch plate to said crossbar, and a pair of axially displaced stops on said crossbar for each rail receiving a respective rail therebetween with the stops of each pair having a first radial surface extending transverse to said passage from adjacent said axis and at a predetermined angle to each other greater than the taper of said rails.

8. The improvement claimed in claim 7 in which the radial surfaces of said stops extend from the periphery of said crossbar past the longitudinal axis of said bar.

9. The improvement claimed in claim 8 in which the projecting end of each tapered rail is provided with a radiused end surface having a center of rotation substantially coincident with the longitudinal axis of said bar.

10. The improvement claimed in claim 9 in which each radial surface is displaced axially of said bar and merges with a second radial surface extending substantially parallel to the axis of said passage along a radiused juncture having a radius substantially similar to the radiused end surface of each tapered rail.

11. The improvement claimed in claim 10 in which each second radial surface parallel to the axis of said passage is substantially coplanar and enables the formation of a first radial surface on an axially coincident adjacent stop by a respective mold half.

* * * * *